United States Patent [19]

Yoshioka

[11] Patent Number: 4,987,340

[45] Date of Patent: Jan. 22, 1991

[54] LEAD WIRE MOUNTING STRUCTURE FOR ELECTROLUMINESCENCE

[75] Inventor: Kenji Yoshioka, Miyagi, Japan

[73] Assignee: Alps Electric Co., Ltd., Tokyo, Japan

[21] Appl. No.: 389,643

[22] Filed: Aug. 4, 1989

[30] Foreign Application Priority Data

Oct. 17, 1988 [JP] Japan ..... 63-134444[U]

[51] Int. Cl.[5] ..... H05B 33/06

[52] U.S. Cl. ..... 313/512; 313/318; 174/65 R; 439/280; 439/375

[58] Field of Search ..... 313/512, 318; 439/278, 439/279, 280, 282, 283, 374, 375; 174/65 R, 65 G

[56] References Cited

U.S. PATENT DOCUMENTS 3,430,088 2/1969 Beswick ..... 313/512

3,509,401 4/1970 Callely et al. ..... 313/512

*Primary Examiner*—Kenneth Wieder

*Attorney, Agent, or Firm*—Guy W. Shoup; Paul J. Winters

[57] ABSTRACT

A lead wire mounting structure for an electroluminescence including a first retainer plate having a plurality of bosses some of which are to be inserted through sealing films of the electroluminescence, and a second retainer plate having a plurality of holes to be engaged with the bosses, wherein the first and second retainer plates are opposed to each other in such a manner as to sandwich marginal end portions of the sealing films, the terminals projecting from the sealing films, and end portions of the insulated lead wires fixedly connected to the terminals, and the bosses of the first retainer plate inserted into the holes of the retainer plate are caulked to firmly hold the marginal end portions of the sealing films and the end portions of the insulated lead wires.

2 Claims, 2 Drawing Sheets

LEAD WIRE MOUNTING STRUCTURE FOR ELECTROLUMINESCENCE

BACKGROUND OF THE INVENTION

The present invention relates to a lead wire mounting structure for an electroluminescence adapted to be used by fixedly connecting its terminals to insulated lead wires.

A dispersion type electroluminescence (which will be hereinafter referred to as EL) is widely used as a backlight for a liquid crystal display since it is manufactured at a low cost and can exhibit a high luminance.

FIG. 2 shows a sectional view of the EL as mentioned above. Referring to FIG. 2, reference numeral 1 generally designates an EL composed of an EL element 3 disposed on a reinforcing plate 2, a pair of sealing films 4 and 5 for sealing the EL element 3, and a pair of flat terminals 6 and 7 projecting outside between the sealing films 4 and 5 heat-sealed. The EL element is formed by laminating a transparent sheet 9 on which a transparent electrode 8 is formed, a light emitting layer 10 formed by dispersing a phosphor in an organic binder, and a counter electrode 11 formed of metal foil of the like. The terminals 6 and 7 are lead out from the transparent electrode 8 and the counter electrode 11.

When the terminals 6 and 7 are connected to an AC power supply to apply a predetermined voltage between the electrodes 8 and 11, the light emitting layer 10 is operated to emit light, and the light is transmitted through the sealing film 4 having a light transmissivity to the outside.

In the case that a position of installation of the EL 1 into an equipment such as a liquid crystal display is at a distance from the power supply, the terminals 6 and 7 are required to be electrically connected through long insulated lead wires to the power supply. Conventionally, reliable connection of the insulated lead wires to the EL has been established by the construction as shown in FIG. 3. Referring to FIG. 3, the sealing films 4 and 5 of the EL 1 are formed to project at portions where the terminals 6 and 7 project. After the terminals 6 and 7 are soldered to bare end portions of insulated lead wires 15 and 16, a pair of heat-shrinkage resin tubes 17 and 18 are provided to cover connecting areas extending from the projecting portions of the sealing films 4 and 5 to insulated end portions of the insulated lead wires 15 and 16, respectively. Then, the resin tubes 17 and 18 are heated to be shrunk.

However, the above-mentioned construction has the following problems. First, prior to soldering the bare end portions of the insulated lead wires 15 and 16 to the terminals 6 and 7, the resin tubes 17 and 18 surrounding the insulated lead wires 15 and 16 must be isolated from the soldering portions, and after the soldering, they must be moved to a predetermined position where the connecting areas are covered with the resin tubes 15 and 16. Thus, it is troublesome to handle the resin tubes 17 and 18 which are small, causing a deterioration of workability. Secondly, the projecting portions of the sealing films 4 and 5 to be covered with the resin tubes 17 and 18 are weak in strength, resulting that stress concentration is generated at the bases of the projecting portions. Accordingly, there is a possibility that the projecting portions of the sealing films 4 and 5 will be cracked or separated and that the terminals 6 and 7 will be broken.

SUMMARY OF THE INVENTION

It is an object of the present invention to provide a lead wire mounting structure for the EL which may improve the workability in mounting the lead wires to the EL and ensure the reliability after mounting the lead wires.

According to the present invention, there is provided in a mounting structure of insulated lead wires to an electroluminescence including a laminated element composed of a transparent electrode, a light emitting layer and a counter electrode, a pair of sealing films for sealing said laminated element, and a pair of terminals led out from said transparent electrode and said counter electrode and projecting from marginal edges of said sealing films for electrical connection with said insulated lead wires; the improvement comprising a first retainer plate having a plurality of bosses some of which are to be inserted through said sealing films, and a second retainer plate having a plurality of holes to be engaged with said bosses, wherein said first and second retainer plates are opposed to each other in such a manner as to sandwich marginal end portions of said sealing films, said terminals projecting from said sealing films, and end portions of said insulated lead wires fixedly connected to said terminals, and said bosses of said first retainer plate inserted into said holes of said retainer plate are caulked to firmly hold said marginal end portions of said sealing films and said end portions of said insulated lead wires.

With this structure, after connecting the terminals of the EL with the insulated lead wires, the first and second retainer plates are combined with each other by caulking the bosses to thereby firmly hold the marginal end portions of the sealing films and the end portions of the insulated lead wires. Accordingly, the workability in mounting the insulated lead wires to the EL may be improved as compared with the conventional mounting structure where the small resin tubes need to be moved relative to the insulated lead wires. Furthermore, as the sealing films have no projecting portions as formed int he conventional mounting structure but they are held at the marginal end portions between the opposed retainer plates, stress may be dispersed to prevent the generation of stress concentration, thereby improving the reliability after mounting the insulated lead wires.

Other objects and features of the invention will be more fully understood from the following detailed description and appended claims when taken with the accompanying drawings.

DETAILED DESCRIPTION OF THE PREFERRED EMBODIMENT

Figure 1A:
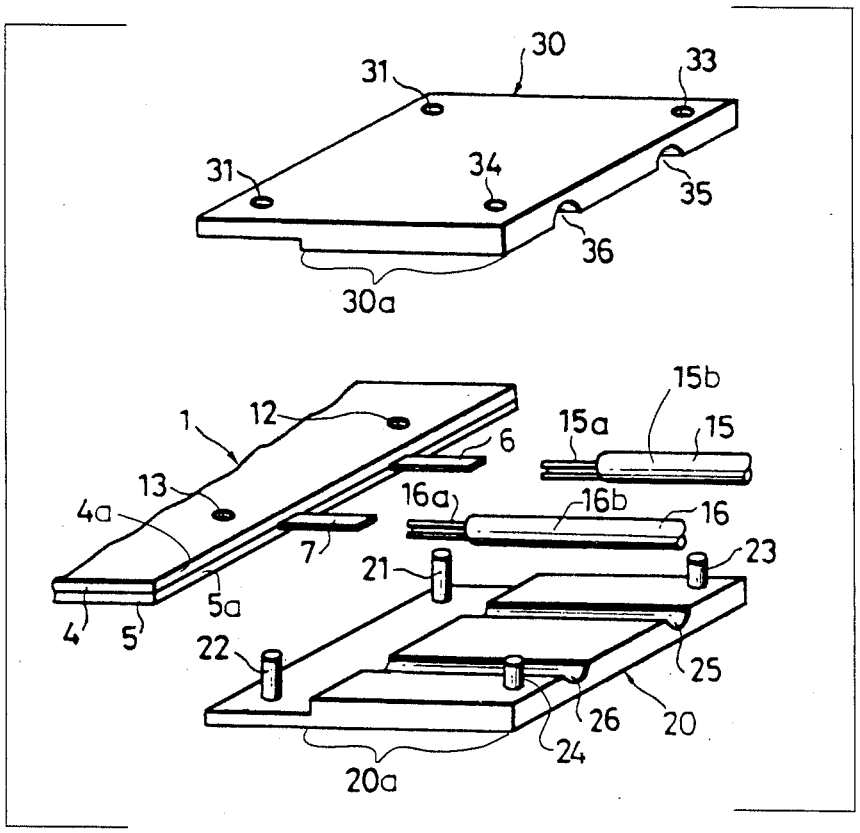
FIG. 1A is an exploded perspective view of a preferred embodiment of the mounting structure according to the present invention.
Figure 1B:
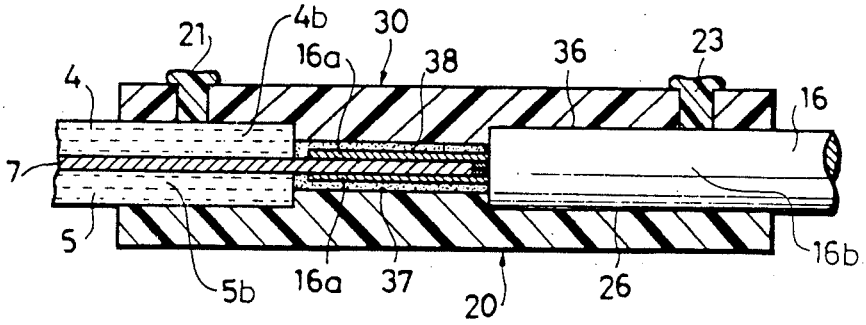
FIG. 1B is a vertical sectional view of an essential part of the mounting structure shown in FIG. 1A after assembled.
Figure 2:
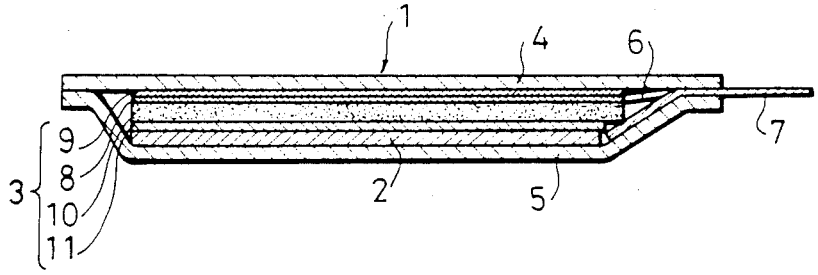
FIG. 2 is a vertical sectional view of the EL.
Figure 3:
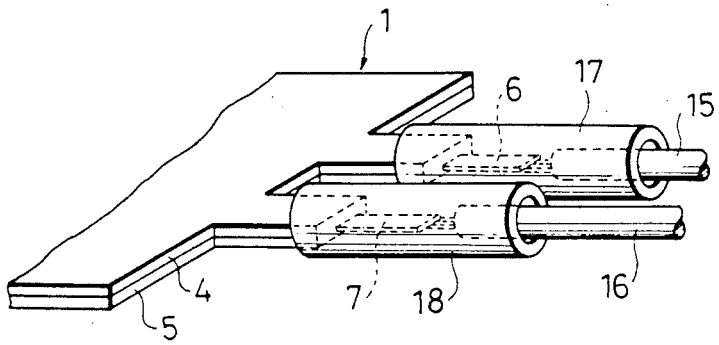
Fig. 3 PRIOR ART
FIG. 3 is a perspective view of the mounting structure in the prior art.

There will now be described a preferred embodiment of the present invention with reference to FIGS. 1A and 1B wherein the same or corresponding parts as those in FIGS. 2 and 3 are designated by the same reference numerals.

Referring to FIG. 1A, reference numerals 20 and 30 designate a pair of retainer plates formed of resin. The first retainer plate 20 is formed at its four corners with bosses 21, 22, 23 and 24, and the second retainer plate 30 is formed at its four corners with holes 31, 32, 33 and 34 to be engaged with the bosses 21–24, respectively. Further, the first retainer plate 20 is formed at its thick-walled portion 20*a* with a pair of grooves 25 and 26, and the second retainer plate 30 is formed at its thick-walled portion 30*a* with a pair of grooves 35 and 36, so that when the first and second retainer plates 20 and 30 are combined with each other, a pair of insulated lead wires 15 and 16 may be received in a couple of the grooves 25 and 35 and a couple of the grooves 26 and 36, respectively. The sealing films 4 and 5 of the EL 1 are formed with a pair of holes 12 and 13 in the vicinity of the terminals 6 and 7, respectively, for inserting the bosses 21 and 22 of the first retainer plate 20 therethrough. The terminals 6 and 7 led out from a transparent electrode and a counter electrode (both now shown) of the EL 1 project from marginal edges 4*a* and 5*a* of the sealing films 4 and 5.

In mounting the insulated lead wires 15 and 16 to the EL 1, bare end portions 15*a* and 16*a* of the insulated lead wires 15 and 16 are soldered to the terminals 6 and 7, respectively. Then, the bosses 21 and 22 of the first retainer plate 20 are inserted through the holes 12 and 13 of the sealing films 4 and 5 into the holes 31 and 32 of the second retainer plate 30, respectively. Simultaneously, the bosses 23 and 24 of the first retainer plate 20 are inserted into the holes 33 and 34 of the second retainer plate 30, respectively, thus combining the first and second retainer plates 20 and 30. At this time, insulated end portions 15*b* and 16*b* of the insulated lead wires 15 and 16 are disposed in the couple of grooves 25 and 35 and the couple of grooves 26 and 36, respectively. Thereafter, the end portions of the bosses 21–24 projecting from the holes 31–34 are caulked to thereby firmly hold the marginal end portions 4*b* and 5*b* of the sealing films 4 and 5 and the insulated end portions 15*b* and 16*b* of the insulated lead wires 15 and 16 as well as the terminals 6 and 7 and the bare end portions 15*a* and 16*a* of the insulated lead wires 15 and 16.

Referring to FIG. 1B which is a vertical sectional view of the assembly of the EL 1 with the insulated lead wires 16 and 16, the insulated end portion 16*b* of the insulated lead wire 16, for example, is closely fitted in the couple of grooves 26 and 36 of the first and second retainer plates 20 and 30 by caulking the bosses 21–24. On the other hand, the marginal end portions 4*b* and 5*b* of the sealing films 4 and 5 are closely held between thin-walled portions 20*b* and 30*b* of the first and second retainer plates 20 and 30 by caulking the bosses 21–24. The terminal 7 projecting from the marginal edges 4*a* and 5*a*, for example, is connected with the bare end portion 16*a* of the insulated lead wire 16 in a gap 37 defined between the first and second retainer plates 20 and 30, and is soldered at 38 to the bare end portion 16*a* in the gap 37.

As mentioned above, the EL 1 and the insulated lead wires 15 and 16 can be firmly connected by soldering the bare end portions 15*a* and 16*a* of the insulated lead wires 15 and 16 to the terminals 6 and 7 of the EL 1, respectively, thereafter combining the first and second retainer plates 20 and 30, and then caulking the bosses 21–24. Accordingly, the workability in mounting the insulated lead wires 15 and 16 may be improved as compared with the conventional mounting structure as previously mentioned. Furthermore, as the marginal end portions 4*b* and 5*b* of the sealing films 4 and 5 have no projecting portions as needed in the conventional mounting structure, but they are held between the first and second retainer plates 20 and 30. Accordingly, the stresses to be generated at the marginal end portions 4*b* and 5*b* may be dispersed to thereby prevent separation of the sealing films 4 and 5 or breakage of the terminals 6 and 7 due to stress concentration. Thus, the reliability after mounting the insulated lead wires 15 and 16 may be improved.

It should be appreciated that the shape of the retainer plates 20 and 30 as well as the position and the number of the bosses are not limited to the above-mentioned preferred embodiment.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. In a mounting structure of insulated lead wires to an electroluminescence including a laminated element composed of a transparent electrode, a light emitting layer and a counter electrode, a pair of sealing films for sealing said laminated element, and a pair of terminals led out from said transparent electrode and said counter electrode and projecting from marginal edges of said sealing films for electrical connection with said insulated lead wires; the improvement comprising a first retainer plate having a plurality of bosses some of which are to be inserted through said sealing films, and a second retainer plate having a plurality of holes to be engaged with said bosses, wherein said first and second retainer plates are opposed to each other in such a manner as to sandwich marginal end portions of said sealing films, said terminals projecting from said sealing films, and end portions of said insulated lead wires fixedly connected to said terminals, and said bosses of said first retainer plate inserted into said holes of said retainer plate are caulked to firmly hold said marginal end portions of said sealing films and said end portions of said insulated lead wires.

2. The lead wire mounting structure as defined in claim 1, wherein said first and second retainer plates are formed on their opposed surface with at least two grooves for receiving said insulated lead wires.

* * * * *

UNITED STATES PATENT AND TRADEMARK OFFICE

CERTIFICATE OF CORRECTION

PATENT NO. : 4,987,340

DATED : January 22, 1991

INVENTOR(S) : Kenji Yoshioka

It is certified that error appears in the above-identified patent and that said Letters Patent is hereby corrected as shown below:

Column 4, line 59, claim 2, "surface" should read --surfaces--.

Signed and Sealed this

Seventh Day of July, 1992

*Attest:*

*Attesting Officer*

DOUGLAS B. COMER

*Acting Commissioner of Patents and Trademarks*